United States Patent [19]

Uffelman

[11] 3,973,250

[45] Aug. 3, 1976

[54] ACOUSTICALLY COUPLED BURGLAR ALARM SYSTEM

[76] Inventor: Malcolm R. Uffelman, 1808 Horseback Trail, Vienna, Va. 22180

[22] Filed: Nov. 12, 1974

[21] Appl. No.: 523,240

[52] U.S. Cl. ..... 340/274 R; 116/137 A; 181/139; 340/416

[51] Int. Cl.[2] ..... G08B 13/08

[58] Field of Search ..... 340/274, 416, 261, 258 D, 340/258 C; 116/137 A, 65, 86, 6; 181/139, 142

[56] References Cited

UNITED STATES PATENTS

| | | | |
|---|---|---|---|
| 2,611,334 | 9/1952 | Counts et al. | 116/86 |
| 2,905,762 | 9/1959 | Rettie et al. | 340/416 |
| 3,125,986 | 3/1964 | Fortman et al. | 116/137 A |
| 3,230,923 | 1/1966 | Hughes | 116/137 A |
| 3,804,053 | 4/1974 | Gray | 116/86 |
| 3,810,146 | 5/1974 | Lieb | 340/261 |
| 3,863,240 | 1/1975 | Galvin | 340/258 C |

*Primary Examiner*—Glen R. Swann, III

[57] ABSTRACT

An ultrasonic whistle is mounted together with a pin on a window or door so that movement of the window or door causes relative movement between the whistle and pin. Such movement releases compressed gas from a container which activates the whistle. A central monitor in the building detects the output of the whistle and provides an output to activate alerting devices.

5 Claims, 7 Drawing Figures

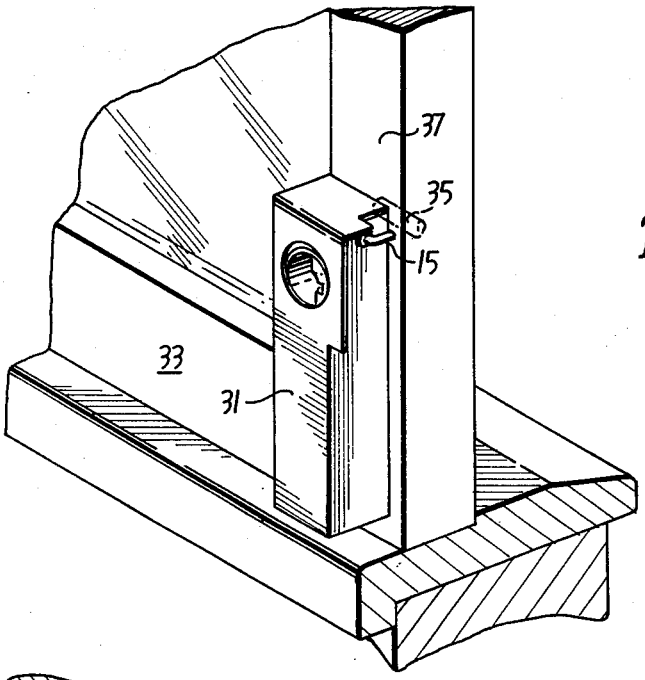
FIG. 2
FIG. 3
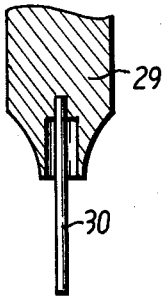
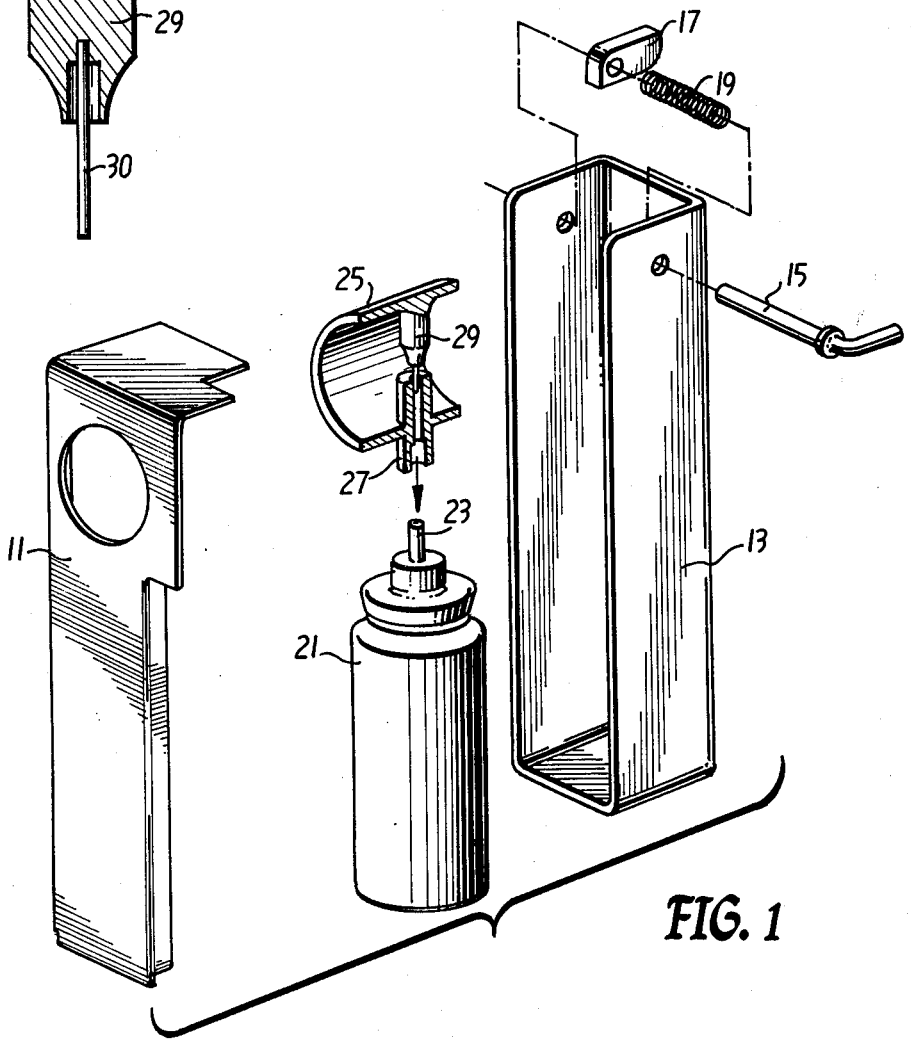
FIG. 1

FIG. 4
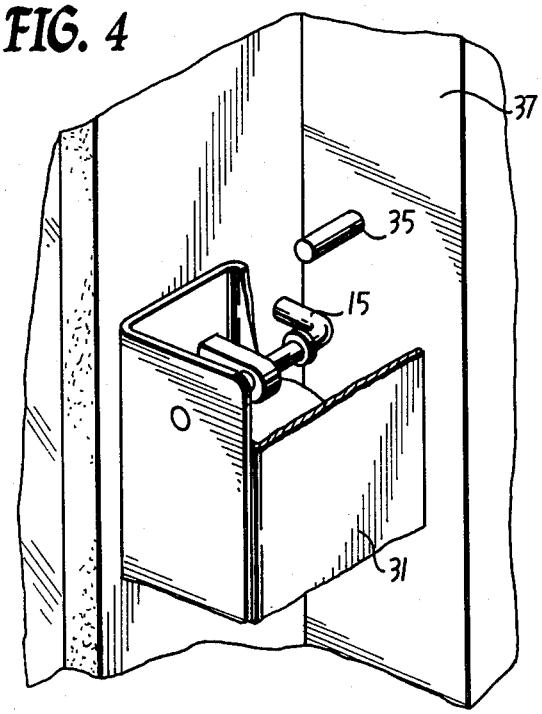
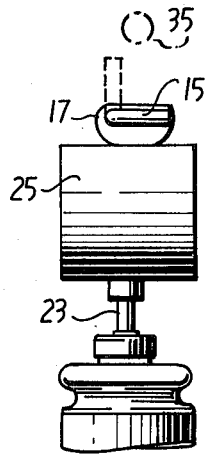
FIG. 5A
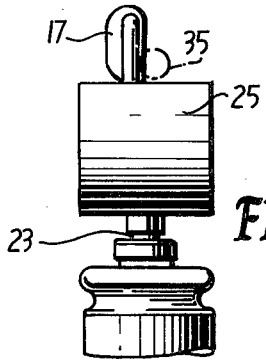
FIG. 5B
FIG. 6
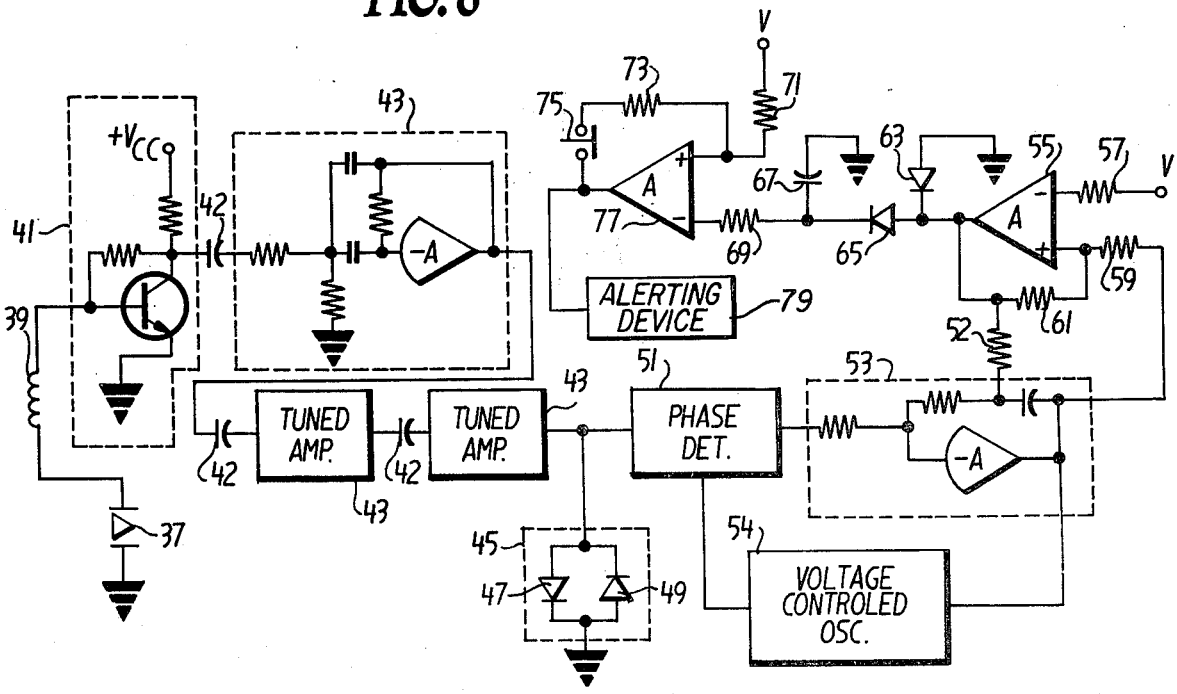

ACOUSTICALLY COUPLED BURGLAR ALARM SYSTEM

This invention broadly relates to a system for detecting unauthorized entry and for activating alerting or signaling devices and more specifically to a burglar alarm system using an ultrasonic generator.

BACKGROUND OF THE INVENTION

Burglar alarm systems generally fall into one of two types Perimeter Systems that protect the perimeter with sensors on doors, windows, and other openings, and Space Systems that protect an area or space by use of motion detections, i.e. ultrasonic or microwave, light beams, trip wires, etc. Space Systems, particularly for home use, are generally of the motion detection type. This type of burglar alarm detects movement in an area rather than detecting entry into the area through an opening. Because the volume of the space that can be monitored by a single unit is limited, a multiplicity of units is generally required, which causes this type of system to be costly. Further, this type of system, because it detects all motion, tends to have a high false alarm rate.

The most commonly used perimeter system is based on the use of switch devices at the entry points. These switch devices are wired together in series and the circuit is terminated at a central monitor, generally some form of bridge circuit coupled with a latching circuit. If the series circuit is broken, the central monitor detects the open circuit condition and causes the latching circuit to latch and to activate an alerting or signaling device. This system is simple in theory, reliable in practice, and has a low false alarm rate if properly used. However, because of the extensive wiring needed and the normal desire to conceal the wiring (particularly in homes), this type of system is difficult and expensive to install.

Another commonly encounted perimeter system that removes the need for connecting wires, uses sensors at each opening that are based on switches to detect the unauthorized opening, and a low power radio frequency transmitter to send a signal to a central receiver if entry occurs. This system circumvents the need to install extensive wiring and is, therefore, less expensive than the wired perimeter system. However, each sensor is a complex electronic unit, and such units are expensive. Also, because each sensor must contain a battery to provide power, the sensors are sensitive to power drain and tend to be unreliable. These systems unless they use complex, and therefore more costly, coding schemes tend to have a high false alarm rate.

From the above discussion, it can be seen that a type of alarm system that is inexpensive, easy to install, reliable, and possessed of a low false alarm rate is needed. It is the purpose of this invention to provide a burglar alarm system having these desirable features.

BRIEF DESCRIPTION OF THE DRAWING

The invention will be clearly understood from the following illustrative descriptions when taken in conjunction with the drawings wherein:

FIG. 1 is an exploded view of a preferred embodiment of a sensor unit used in the present invention;

FIG. 2 is a perspective view of the sensor of FIG. 1 mounted on a window;

FIG. 3 is a partial sectional view of the whistle stem of FIG. 2;

FIG. 4 is a perspective view showing the actuating mechanism within the sensor of FIG. 2;

FIGS. 5*a* and 5*b* illustrate the sensor action as the window is opened; and FIG. 6 is a schematic illustration of a central monitor which may be used with the sensor.

SUMMARY OF THE INVENTION

Broadly, the invention consists of an ultrasonic whistle which is mounted together with a pin on a window or door so that movement of the window or door causes relative movement between the whistle and pin. Such movement releases compressed gas from a container which activates the whistle. A central monitor in the building detects the output of the whistle.

Thus, the ultrasonic signal produced by the whistle provides the method of communication between the sensors and the central monitor. A whistle frequency in the ultrasonic range is used to prevent false alarms due to naturally occuring sounds in the audible region and to reduce the general noise background level in which the signal is to be detected and thereby insuring a high signal to noise ratio. If the system is operated in the audible region, these problems are very prevalent.

DESCRIPTION OF THE PREFERRED EMBODIMENT

Turning now more specifically to FIG. 1; there is illustrated one embodiment of a sensor unit which comprises a cover plate 11 and a housing case 13. Inserted in the housing case 13 is an operating rod 15. Mounted on and fixed to the operating rod 15 is a cam 17. The operating rod 15 is retained in the housing case 13 by spring 19. Contained in housing case 13 is a can 21 containing a compressed gas. For the purpose of this explanation, the compressed gas will be considered to be $CCl_2F_2$, a compound known as Freon-12 (a Dupont trademark). The gas can 21 is equipped with a valve 23. Valve 23 can be any one of a number of commercially available valves such as those manufactured by the Precision Valve Company. Also contained in the housing case 13 is a whistle assembly 25 comprising a channel 27 that fits on the valve 23 and provides a passage for gas flow and a whistle cavity fixture 29. The channel 27 taken together with the whistle cavity fixture 29 and the whistle assembly 25, form a stem whistle such as described by Litsios "IEEE Transactions on Ultrasonic Engineering" Page 91, 1963 and by Savory "Engineering" 170, 99, 136, 1950. A detailed view of the cavity in the whistle stem is shown in FIG. 3. Empirical results show that the nominal frequency for such a whistle using a stem 30 having a diameter of 1/32 inch and $CCl_2F_2$ as the activating gas can be calculated by $$\text{Frequency} = \frac{5760}{4(\text{Cavity Depth in inches}) + .4(\text{Cavity Diameter in inches})}$$

For example, a cavity of 0.072 inches diameter and 0.033 inches depth would produce a nominal frequency of 23,300 hertz using Freon-12. The design and theory of operating for stem whistles is well described in the referenced article.

FIG. 2 illustrates how the sensor unit would be mounted to provide protection for a sash window. The sensor unit is attached to the lower sash 33 by means of screws (not shown) through the housing case 13 or by an adhesive compound on the rear of the housing case 13. Thus, the sensor unit 31 is free to move with the lower sash. A pin or screw 35 is mounted in the fixed frame 37 of the window (often called the inside stop strip) as shown in FIG. 2.

FIG. 4 shows in more detail the mounting configuration of interest. The pin 35 is mounted in the frame 37 such that it is above and off axis of the operating rod 15. It can be seen that as the window sash 33 is raised, the operating rod 15 will meet the pin 35 and as the sash 33 continues to be raised the pin 35 will cause the rod 15 to rotate. FIG. 5 helps explain the result of the rotation of the operating rod 15. In FIG. 5 a rod 15 is shown in the normal armed position. The dotted line representation of the rod 15 shows how the sensor would be set to open the window without alarm. As the sash is raised, indicated by the arrow in FIG. 5*a*, and the rod 15 meets the pin 35 the rod rotates causing the attached cam 17 to also rotate and push the whistle assembly 25 against the valve 23. This action causes the valve 23 to depress and open. FIG. 5*b* shows the position of the cam 17 after it has caused the whistle assembly 25 to depress the valve 23. The opening of the valve 23 allows the compressed gas to escape from the can 21 and cause the whistle to produce an acoustic output at its designed frequency.

Thus, to review the action, as the window sash is raised the sensor is caused to operate by the pin 35 and when operated produces an acoustic signal. The signaling frequency used is selected to be above those frequencies commonly encountered in the ambient noise environment to reduce the possibility of false alarm but it should be low enough to avoid large absorption losses during propagation through the air. In general, the frequency is preferably above 20KHz. In the present example, there is used a nominal frequency of 23 KHz. The embodiment just described is only one example of several possible sensor embodiments that can be configured by standard engineering design practice. It should be obvious that the described unit could be easily and directly modified for use with other openings such as sliding or casement windows and doors. Further, the location of the whistle and the pin could be reversed.

FIG. 6 depicts the schematic of one embodiment of the central monitor for this system. The function of the central monitor is to detect the presence of the acoustic signal from an activated sensor and to produce an activating output signal to operate an alerting device or a signaling device. The central monitor must be able to detect and process the acoustic signal in the presence of normal ambient noises without excessive false alarm. Further, the central monitor must be able to process signals from whistles manufactured with normal tolerance which causes the frequency to deviate from the nominal. The embodiment illustrated in FIG. 6 has the capability to correctly detect low level acoustic signals in the frequency tolerance region while having strong resistance to falsely detect noise-like or transient signals. The central monitor uses an acoustic transducer 37 such as a Massa Ultrasonic Transducer TR-89B, type 23, manufactured by Massa Division, Dynamics Corporation of America to convert the acoustic signal into an electrical signal. Since these types of of transducers are normally capacitive, inductor 39 is used to tune the transducer. Transistor amplifier 41 is connected in a standard configuration to provide low input impedance and high voltage gain for a low level signal. The signal from the transistor amplifier 41 is coupled through the blocking capacitor 42 into a tuned amplified stage 43. The design of the tuned amplifier 43 shown is only one of several equivalent embodiments. This particular design is described in detail in "Swift, Sure Design of Active Bondpass Filter" by Doyle, in "Electronic Design News" January 1970. Because the central monitor must be able to detect signals from sensors located at considerable distances, more than one stage of amplification will normally be required. FIG. 6 indicates three stages for purposes of illustration. The bandwidths of the amplifiers are set to cover the range of whistle frequencies. At the output of the final tuned amplifier 43 is a limiter 45 composed of diodes 47 and 49. The purpose of the limiter is to limit the power input to phase detector 51. This helps to reduce the false alarms due to noise. The theory of using a limiter in this design is discussed in chapter 5 of "Phaselock Techniques" by Gardner, John Wiley and Sons, Inc. 1966. After limiting by the limiter 45, the signal is applied to a phase detector 51. The exact design of the phase detector is not important since any of those described in the reference cited above may be used. For simplicity and low cost, a switching phase detector is preferred. The signal from the phase detector is applied to an active loop filter 53 as described in detail in Chapter 2 of "Phaselock Techniques" as cited above. The output of the loop filter 53 is applied to a voltage controlled oscillator 54 which can be any of several standard designs as described in Chapter 5 of "Phaselock Techniques". The frequency range of the voltage controlled oscillator is set to equal the expected range of whistle frequencies. Taken together phase detector 51, loop filter 53, and voltage controlled oscillator 54 connected as shown in FIG. 5 form a phase locked loop. The bandwidth of the phase locked loop is narrow compared to the range of the whistle tolerances to reduce false alarms due to noise. The theory and practice of phase locked loops is well covered in the literature and will not be explained here. "Phaselock Techniques" by Gardner is an excellent reference.

When there is no signal present, the phase locked loop is caused to search over the frequency range that the sensor whistles will occupy by the action of amplifier 55 and its associated circuit components. This action can be explained as follows. The amplifier 55 is a high gain, differetial differential (such as LM30IA manufactured by National Semiconductor). The output of the loop filter 53 is applied to the non-inverting input of amplifier 55 through a resistor 59. A fixed positive reference voltage V is applied to the inverting output of the amplifier 55 through a resistor 57. Further the output of the amplifier 55 is also connected to the non-inverting input through resistor 61. As long as the sum of the currents through resistors 61 and 59 is less than or equal to the current through resistor 57, the voltage output of the amplifier 55 will try to go to the maximum negative voltage. The maximum negative voltage that can be at the amplifier 55 output is limited by the diode 63 to a value of approximately three quarters of a volt below ground. This causes a negative signal to be applied to the integrator formed by resistor 52 connected to the loop filter. This small negative signal will cause the output of the loop filter 53 to increase in voltage with time. In other words the loop filter 53 output will be a positive voltage ramp. As noted above, the output of the loop filter 53 is applied to the voltage controlled oscillator 54, and causes it to vary its frequency over the range to be searched. When the voltage reaches a value where the sum of the currents through resistors 61 and 59 are greater than the current through resistor 57, the output of the amplifier 55 will switch to the maximum positive output voltage. This provides a large positive signal into the resistor 52 which causes the output of the loop filter to drop rapidly (a negative voltage ramp with a slope of greater magnitude than the positive ramp) until the point is reached where the sum of the currents in resistors 61 and 59 are again less than the current in resistor 57. At this point, the output of the amplifier 55 will switch back to its slightly negative state, and the above process will repeat. Thus, the action caused by the amplifier 55 and its associated circuit components is a searching sweep over the frequency range, a reset, and a repeat of the search sweep, and so on.

If a sensor signal is present, the phase locked loop will lock onto the frequency as it sweeps through the frequency. This action, in the presence of a sweep circuit, is well explained in "Phaselock Techniques" cited above. The important point is that when the phase locked loop is in lock, the voltage output of the loop filter 53 remains constant and does not cause the conditions needed to produce the reset and, therefore, the voltage out of amplifier 55 remains at the negative level for the duration of the sensor signal.

When there is no sensor signal present, the output of amplifier 55 goes to a high positive value of voltage once every search sweep. This positive voltage charges the capacitor 67 through the diode 65. During the search sweep the charge on the capacitor 67 is drawn off through resistor 69. As long as there is no sensor signal present, the capacitor 67 gets charged once each search sweep and the current through resistor 69 remains greater than the current through resistors 71 and 73.

If a sensor signal causes the phase locked loop to remain in lock for a sufficient time, the voltage acress capacitor 67 will fall so low that the current through resistor 69 is less than the current through resistors 71 and 73 and the output of amplifier 77 will switch to its maximum positive state and indicate the detection of an unauthorized entry. The time constant of the discharge rate of capacitor 67 is set by the product of the value of the capacitor 67 and resistor 69. This time constant is set such that a signal of approximately 1 second duration is required. This helps reduce false alarm due to transients. The values of resistors 69, 71, and 73 are selected such that once the output becomes positive it will remain so even though the sensor signal ceases. The ouput of amplifier 77 can be used to activate any one or more of several commonly used alerting devices 79 such as a siren, electrical bell, flood lights, etc. A normally closed switch 75 is provided to reset amplifier 77 to the low output state. If the building to be protected is very large, more than one central monitor may be required.

The above description and drawings are illustrative only since various components could be substituted without departing from the invention. Accordingly, the invention is to be limited only by the scope of the following claims.

What is claimed is:

1. An entry alarm system for a building comprising:
gas powered means for generating an ultrasonic signal;
means for securing said means for generating an ultrasonic signal to a movable closure in said building whereby movement of said closure activates said gas powered generating means;
first means for detecting the signal output of said gas powered generating means and converting said ultrasonic signal into an electric signal;
a tuned amplifier coupled to the output of said first means for amplifying the said electrical signal;
second means coupled to the output of said tuned amplifier for reducing the influence of background noise in the frequency range of the output of said tuned amplifier;
third means coupled to the output of said second means for searching over the frequency range of the output of said tuned amplifier to determine the presence of said electric signal;
fourth means coupled to said third means for detecting the output of said third means; and
an alerting device coupled to the output of said fourth means.

2. The 20 system of claim 1 wherein the output frequency of said ultrasonic signal generating means is not lower than 20KHz.

3. The alarm system of claim 1 wherein said ultrasonic generating means comprises:
a container of compressed gas including a valve;
a whistle mounted on said valve;
a cam for depressing said valve and releasing said gas;
an operating rod connected to said cam; and
a pin mounted in said closure such that movement of said closure causes contact between said operating rod and said pin to move said operating rod and said attached cam to depress said valve.

4. The alarm system of claim 3 wherein said operating rod is moveable to a position to avoid contact with said pin.

5. The alarm system of claim 1 wherein said first means for detecting the signal output of said gas powered signal generating means comprises
an acoustic transducer having its output coupled to said tuned amplifier; and
said third means comprises
a sweeping phase locked loop.

* * * * *